US006824407B1

(12) United States Patent
Zhao et al.

(10) Patent No.: US 6,824,407 B1
(45) Date of Patent: Nov. 30, 2004

(54) CARD EDGE CONNECTOR WITH LATCH

(75) Inventors: Qijun Zhao, Kunsan (CN); Jinkui Hu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/658,223

(22) Filed: Sep. 8, 2003

(30) Foreign Application Priority Data

Jun. 3, 2003 (KR) ..... 92210228

(51) Int. Cl.[7] ..... H01R 13/62
(52) U.S. Cl. ..... 439/157; 439/328
(58) Field of Search ..... 439/157, 159, 439/160, 152–156, 325, 328, 327, 329

(56) References Cited

U.S. PATENT DOCUMENTS 5,445,531 A * 8/1995 Billman et al. ..... 439/160
5,470,242 A * 11/1995 Cheng et al. ..... 439/157
5,603,625 A 2/1997 Tondreault
5,634,803 A 6/1997 Cheng et al.
5,662,485 A 9/1997 Yip et al.
5,690,499 A * 11/1997 Howell et al. ..... 439/157
6,200,149 B1 * 3/2001 Chi-Chung ..... 439/160

* cited by examiner

*Primary Examiner*—Hien Vu
(74) *Attorney, Agent, or Firm*—Wei Te Chung

(57) ABSTRACT

A card edge connector (1) includes an insulative housing (10), a number of electrical contacts (20), and a pair of latch members (40). The insulative housing defines a mating face (11), a slot (110) in the mating face, a number of passageways (112) communicating with the slot, and a pair of support arms (13) extending upwardly from each end thereof. The electrical contacts are received in the passageways of the insulative housing. Each latch member is piovtably movable with respect to the insulative housing from a locked position to a released position and includes a main section (41) pivotably assembled to the arms on the end of the insulative housing and a locking section (44) extending from the main section at an acute angle relative to the mating face of the insulative housing in the locked position.

9 Claims, 4 Drawing Sheets

CARD EDGE CONNECTOR WITH LATCH

BACKGROUND OF THE INVENTION

1. Field of the Invention

The present invention generally relates to a card edge connector, and more particularly to a card edge connector having a latch for locking a complementary electrical card received therein.

2. Description of Related Art

Card edge connectors which electrically connect electrical cards to mother boards within a limited space of a computer or other like electronic device are well known. A conventional card edge connector as shown in U.S. Pat. Nos. 5,603,625, 5,634,803, and 5,662,485 generally includes an insulative housing defining a slot for receiving a mating edge of a complementary electrical card and a plurality of passageways on opposite side walls of the slot and communicating with the slot, a plurality of contacts received in the passageways of the insulative housing and having mating portions exposed in the slot for contact with conductive pads on the mating edge of the complementary electrical card, and a pair of ejectors or latch members at opposite ends of the insulative housing for facilely extract the complementary card held in the slot. The ejectors or latch members are provided with locking sections at top ends thereof which are received within correspondingly sized and shaped cutouts in the complementary electrical cards when the ejectors or latch members are in their locked or upright positions.

However, the conventional locking sections are all horizontally received in the cutouts of the complementary electrical cards and are not held in a reverse direction, the locking sections are apt to disengage from the cutouts, thereby adversely affecting the retention of the electrical cards in the slots of the insulative housings.

Hence, a card edge connector having an improved latch member is desired.

SUMMARY OF THE INVENTION

An object of the present invention is to provide a card edge connector having a latch which can reliably lock a complementary electrical card.

To achieve the above object, a card edge connector comprises an insulative housing, a plurality of electrical contacts, and a latch member. The insulative housing comprises a mating face, a slot in the mating face, a plurality of passageways communicating with the slot, and a pair of support arms extending upwardly from an end thereof. The electrical contacts are received in the passageways of the insulative housing. The electrical contacts are received in the passageways of the insulative housing. Each latch member is piovtably moveable with respect to the insulative housing from a locked position to a released position and includes a main section pivotably assembled to the arms on the end of the insulative housing and a locking section extending from the main section at an acute angle relative to the mating face of the insulative housing in the locked position.

Other objects, advantages and novel features of the invention will become more apparent from the following detailed description when taken in conjunction with the accompanying drawings.

DETAILED DESCRIPTION OF THE INVENTION

Figure 1:
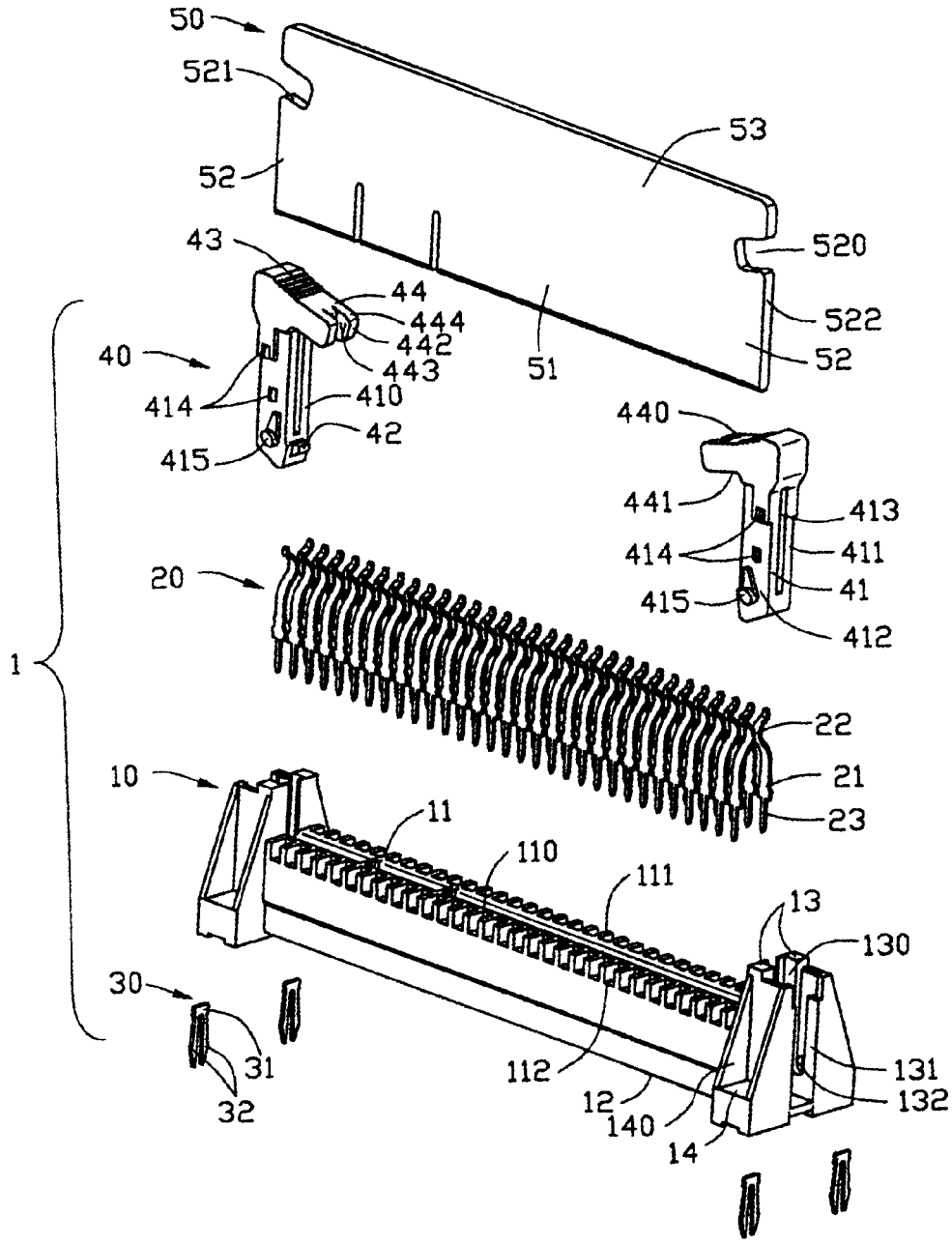
FIG. 1 is an exploded perspective view of a card edge connector in accordance with the present invention and a complementary electrical card.

Referring to FIG. 1, a card edge connector 1 in accordance with the present invention comprises an insulative housing 10, a plurality of electrical contacts 20, two pairs of retention structures 30 and a pair of latch members 40.

The insulative housing 10 comprises a mating face 11, a mounting face 12 opposite to the mating face 11, a slot 110 extending from the mating face 11 toward the mounting face 12 along a longitudinal direction thereof, a plurality of passageways 112 defined on opposite side walls 111 of the slot 110, a pair of support arms 13 spaced from each other and extending upwardly from each end thereof, and a pair of stand-offs 14 formed on outer sides of each pair of support arms 13. The passageways 122 extend from the mating face 11 to the mounting face 12 and communicate with the slots 10. The two support arms 13 on each end of the insulative housing 10 define a receiving space 130 therebetween and communicating with the slot 110, and a pair of holes 132 in inner sides 131 thereof. A pair of ribs 140 are integrally formed with each support arm 13 and the corresponding stand-off 14 to increase the mechanical strength of the support arm 13.

Each electrical contact 20 comprises a body portion 21, a mating portion 22 extending upwardly from the body portion 21 and a tail portion 23 extending downwardly from the body portion 21.

Each retention structure 30 comprises a mounting portion 31 and a pair of leg portions 32 extending downwardly from the mounting portion 31 and spaced from each other.

Figure 2:
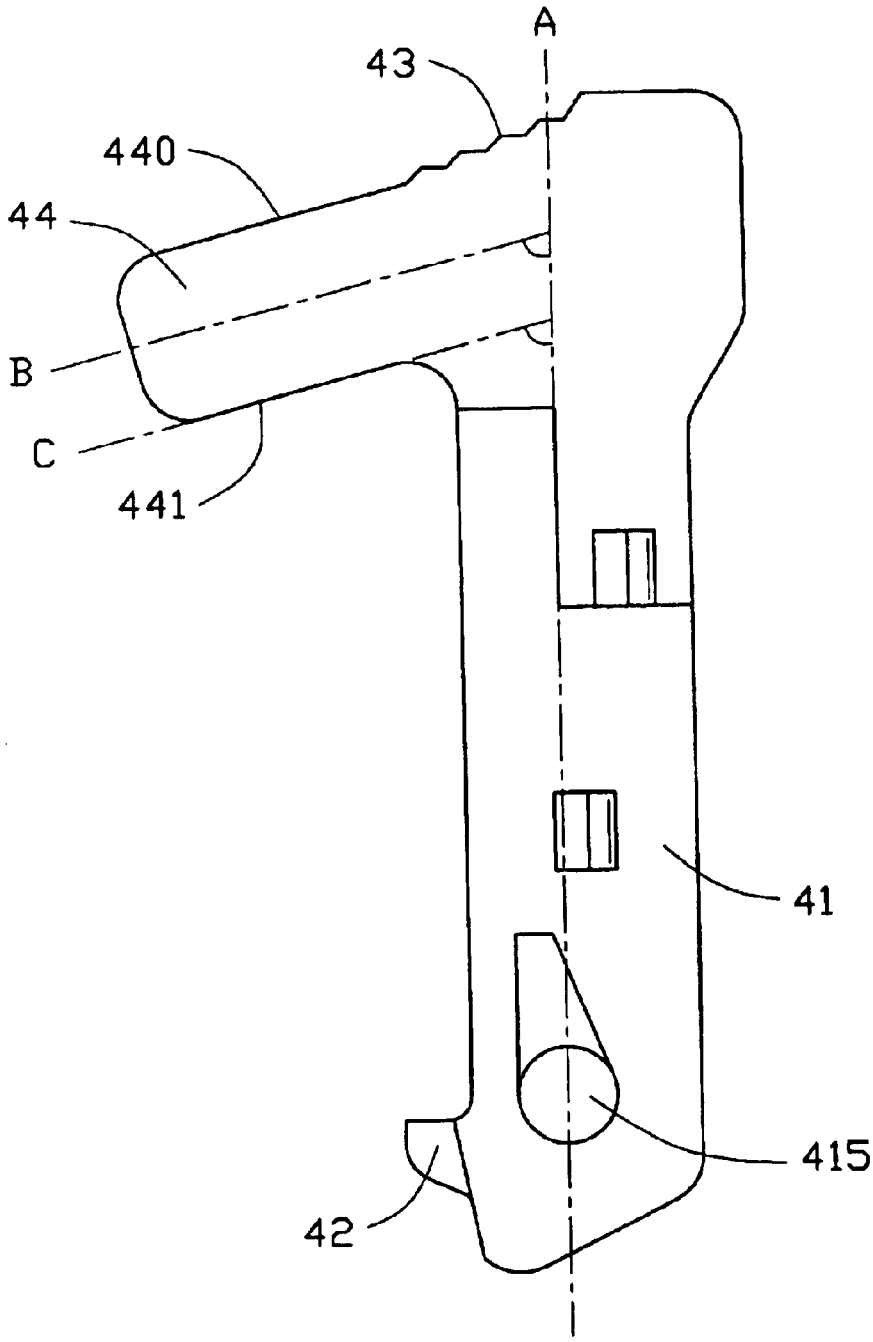
FIG. 2 is an enlarged front plan view of a latch member of the card edge connector of FIG 1.

Also referring to FIG. 1 in conjunction with FIG. 2, each latch member 40 comprises an elongated main section 41 having a longitudinal axis A, an eject section 42, an operation section 43 and a locking section 44. The main section 41 defines an inner face 410, an outer face 411 opposite the inner face 410, two opposite side faces 413, and a slit 413 extending from the inner face 410 to the outer face 411 therealong to increase elasticity of the main section 41. The main section 41 is formed with a plurality of projections 414 and a pair of spindles 415 on the opposite side face 412 thereof. The eject section 42 projects inwardly from a lower end of the inner face 410 of the main section 41. The operation section 43 is formed on a top end of the main section 41 and provides a finger shelf on which to push when actuating the latch member 40. The locking section 44 extends inwardly and downwardly from the top end of the main section 41 in a direction B which is at an angle of about seventy-five degrees relative to the axis A of the main section 41. The locking section 44 has an upper face 440, a locking face 441 opposite and substantially parallel to the upper face 440, an end face 442 connecting the upper face 440 with the locking face 441, and a channel 443 defined in the end face 442 and extending from the upper face 440 to the locking face 441. The locking face 441 of the locking section 44 is in a plane C which is also at an angle of about seventy-five degrees relative to the axis of the main section 41. The channel 443 divides a free end of the locking section 44 into two end pieces 444.

Figure 3:
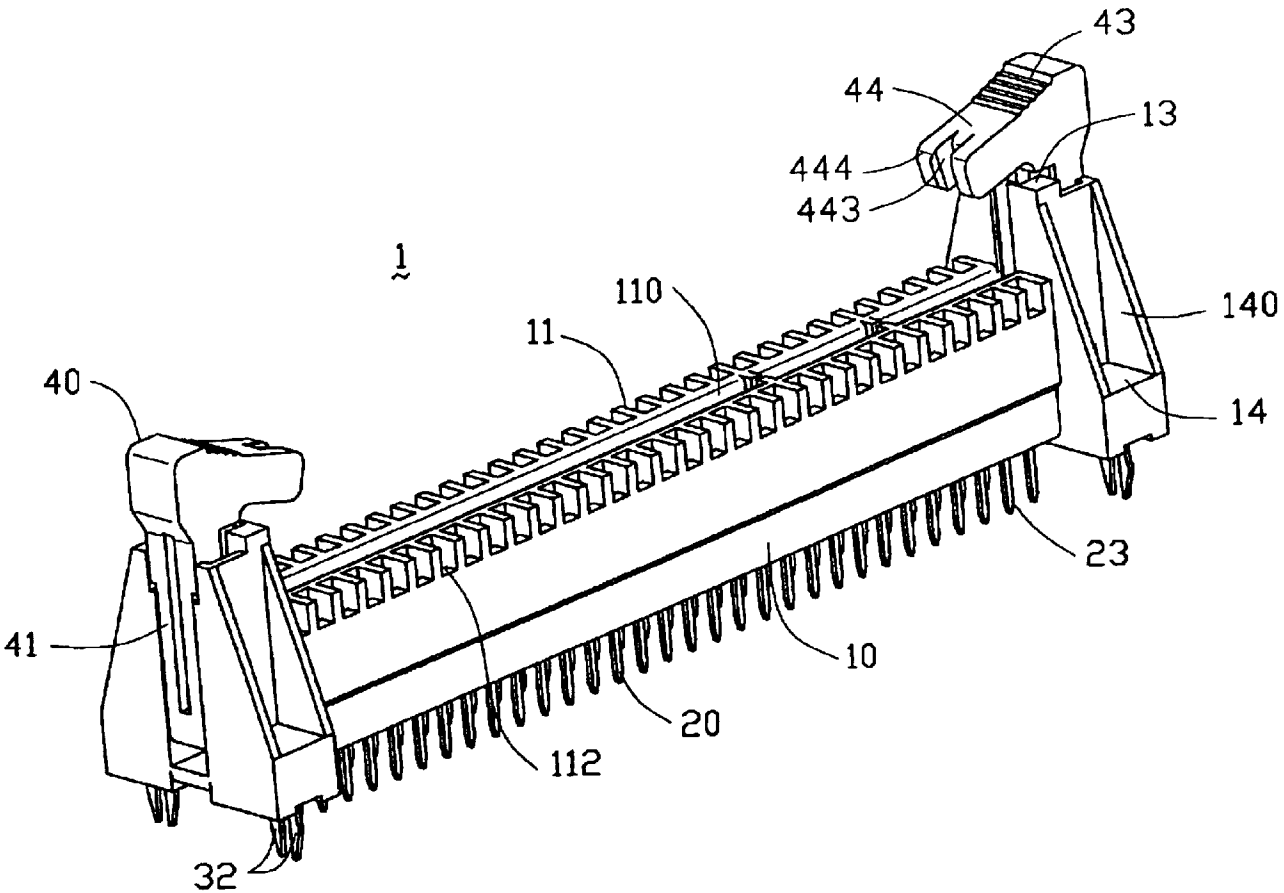
FIG. 3 is an assembled perspective view of the card edge connector of FIG. 1 but taken from a different aspect.

Referring to FIG. 3, in assembly, the electrical contacts 20 are received in the passageways 112 of the insulative housing 10 with the mating portions 22 exposed in the slot 110 and the tail portions 23 extending downwardly beyond the mounting face 12 of the insulative housing 10. The retention members 30 are retained to the insulative housing 10 by the mounting portions 31 interferentially engaging with the stand-offs 14 of the insulative housing 10. The leg portions 32 extend downwardly beyond the mounting face 12 of the insulative housing 10 for inserting into holes of a printed circuit board (not shown) on which the card edge connector 1 is mounted. The latch member 40 is assembled to the insulative housing 10 by the spindles 415 being pivoted in the holes 132 in the inner sides 131 of the two support arms 13 on each end of the insulative housing 10. When the latch member 40 is located in its locked or upright position, the mating section 41 is received in the receiving space 130 between the two support arms 13, the direction B in which the locking section 44 extends and the plane C in which the locking face 441 of the locking section 44 is located are at an angle of about fifteen degrees relative to the mating face 11 of the insulative housing 10. Each latch member 40 can rotate outwardly from its locked or upright position to its released position around the corresponding spindles 415.

Further referring to FIG. 1, an electrical card 50 for mating with the card edge connector 1 comprises a mating edge 51, a pair of latch edges 52 and two opposite side faces 53. Each latch edge 52 defines an end face 522 and a cutout 520 having an engaging face 521 which is at angle of about seventy-five degrees relative to the end face 522.

Figure 4:
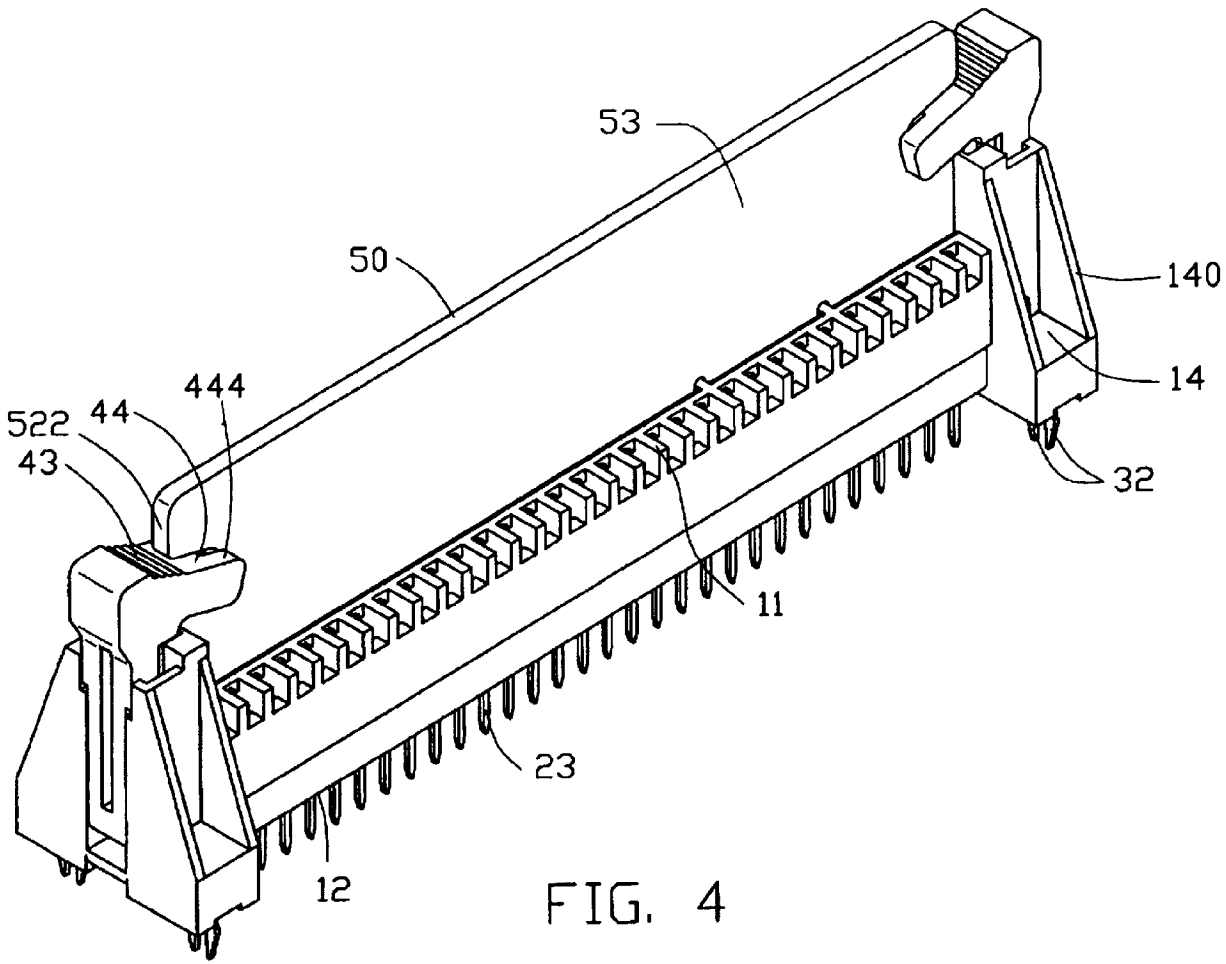
FIG. 4 is a view similar to FIG. 2 but the card edge connector is mated with the complementary electrical card.

Referring to FIG. 4, when the mating edge 51 of the electrical card 50 is fully inserted into the slot 110 of the insulative housing 10, the latch members 40 rotate to their locked or upright positions. The locking sections 44 are received in the cutouts 520 on the latch edges 52 of electrical card 50 with the locking faces 441 abutting against the engaging faces 521 of the cutouts 520. The two end pieces 444 on the free end of the locking section 44 clamp the two side faces 53 of the electrical card 50.

Since the locking face 441 of the locking section 44 and the engaging face 521 of the corresponding cutout 520 is at angle of about fifteen degrees relative to the matins face 11 of the insulative housing 10 when the latch member 40 is located in its locked or upright position, the engaging face 521 can prevent the locking section 44 from disengaging from the cutout 520 of the latch edge 52. In addition, the two pieces 444 on the free end of the locking section 44 clamp the two side faces 53 of the electrical card 50, so the electrical card 50 can be prevent from moving transversally, whereby the electrical card 50 can be stably held in the slots 110 of the insulative housing 10 to secure a reliable electrical connection between the card edge connector 1 and the electrical card 50.

It should be noted that the direction B in which the locking section 44 of the latch member 40 and the locking face 441 of the locking section 44 extend can be at an acute angle of zero-ninety degrees to the mating face 11 of the insulative housing 10 when the latch member 40 is located in its locked or upright position, and the engaging face 521 of the cutout 520 of the electrical card 50 is at the same angle to the mating face 11 of the insulative housing 10 when the mating edge 51 of the electrical card 50 is inserted into the slot 110 of the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

an insulative housing comprising a mating face, a slot defined in the mating face for receiving an electrical card having a cutout with an angle a plurality of passageways communicating with the slot, and a pair of support arms extending upwardly from an end thereof;

a plurality of electrical contacts received in the passageways of the insulative housing; and a latch member pivotably moveable with respect to the insulative housing from a locked position to a released position, the latch member comprising a main section pivotably assembled to the support arms and a locking section extending from the main section at an acute angle relative to the mating face of the insulative housing in the locked position;

wherein the locking section extends from a top end of the main section and has an upper face, a locking face opposite and substantially parallel to the upper face, and an end face connecting the upper face with the locking face, the locking face being at an angle of about fifteen degrees relative to the mating face of the insulative housing in the locked position;

wherein the locking section defines a channel in the end face, the channel extending from the upper face to the locking face and dividing a free end of the locking section into two pieces;

wherein the insulative housing comprises a pair of stand-offs formed on outer sides of the pair of support arms, and a pair of ribs formed with each support arm and a corresponding stand-off;

wherein the insulative housing comprises a pair of retention structures each having a mounting portion engaging with the stand-off of the insulative housing and a pair of leg portions spaced from each other and extending downwardly from the mounting portion beyond the mounting face of the insulative housing; and wherein the insulative housing comprises a second pair of support arms extending upwardly from a second end thereof, and wherein the card the card edge connector comprises a second latch member pivotable on the second pair of support arms of the insulative housing.

2. The card edge connector as claimed in claim 1, wherein the main section has an inner face, an outer face opposite to the inner face, two opposite side faces, and a slit extending from the inner face to the outer face along the main section.

3. The card edge connector as claimed in claim 2, wherein the support arms define a pair of holes in inner sides thereof, and wherein the main section has a pair of spindles formed on the two side faces thereof and received in the holes of the insulative housing.

4. The card edge connector as claimed in claim 1, wherein the latch member comprises an operation section formed on a top end of the main section.

5. The card edge connector as claimed in claim 1, wherein the insulative housing comprises a mounting face opposite to the mating face, the slot extending from the mating face toward the mounting face along the insulative housing, the passageways being defined on opposite side walls of the slot and extending from the mating face to the mounting face.

6. The card edge connector as claimed in claim 5, wherein each electrical contact comprises a body portion, a mating portion extending upwardly from the body portion and exposed in the slot of the insulative housing, and a tail portion extending downwardly from the body portion and beyond the mounting face of the insulative housing.

7. A card edge connector assembly comprising:

an insulative housing comprising mating face, a slot defined in the mating face, a plurality of passageways communicating with the slot, and a pair of support arms extending upwardly from an end thereof;

a plurality of electrical contacts received in the passageways of the insulative housing;

a latch member comprising a main section pivotably mounted on the two arms of the insulative housing, and a locking section extending from the main section and comprising two end pieces; and an electrical card comprising a mating edge inserted into the slot of the insulative housing, and a latch edge clamped by the two end pieces of the locking section of the latch member;

wherein the latch edge defines a cutout having an engaging face which is at an angle of about fifteen degrees relative to the mating face of the insulative housing;

wherein the locking section is received in the cutout of the electrical card and has a locking face which is also at an angle of about fifteen degrees relative to the insulative housing and abuts against the engaging face of the cutout;

wherein the insulative housing comprises a pair of stand-offs formed on outer sides of the pair of support arms, and a pair of ribs formed with each support arm and a corresponding stand-off;

wherein the insulative housing comprises a pair of retention structures each having a mounting portion engaging with the stand-off of the insulative housing and a pair of leg portions spaced from each other and extending downwardly from the mounting portion beyond the mounting face of the insulative housing; and wherein the insulative housing comprises a second pair of support arms extending upwardly from a second end thereof, and wherein the card the card edge connector comprises a second latch member pivotable on the second pair of support arms of the insulative housing.

8. The card edge connector assembly as claimed in claim 7, wherein the locking section extends from a top end of the main section and has an upper face opposite and parallel to the locking face, and an end face connecting the upper face with the locking face.

9. The card edge connector assembly as claimed in claim 7, wherein the support arms defines a pair of holes in inner side thereof, and wherein the main section has two opposite side faces and a pair of spindles formed on the two side faces and received in the holes of the support arms.

* * * * *